United States Patent [19]

Homer et al.

[11] 3,961,600

[45] June 8, 1976

[54] APPARATUS FOR COATING INCANDESCENT LAMP BULBS

[75] Inventors: Horace H. Homer, Arlington; Richard S. Doron, Winchester, both of Mass.; Donald J. Grolemund, Kersey, Pa.

[73] Assignee: GTE Sylvania Incorporated, Danvers, Mass.

[22] Filed: Oct. 23, 1974

[21] Appl. No.: 517,353

[52] U.S. Cl. ..... 118/7; 118/312; 118/317; 118/DIG. 5

[51] Int. Cl.[2] ..... B05C 7/02; B05C 11/10

[58] Field of Search ..... 117/18; 118/308, 312, 118/313, 317, DIG. 5, 7, 622, 309, 612; 302/28, 29, 30

[56] References Cited

UNITED STATES PATENTS

| | | | |
|---|---|---|---|
| 3,233,582 | 2/1966 | Sharetts et al. | 118/DIG. 5 |
| 3,335,024 | 8/1967 | Lopenski et al. | 117/18 X |
| 3,453,134 | 7/1969 | Haw | 117/18 X |
| 3,554,164 | 1/1971 | West | 118/308 X |
| 3,607,553 | 9/1971 | Fritzsche | 117/18 X |

*Primary Examiner*—John P. McIntosh
*Attorney, Agent, or Firm*—James Theodosopoulos

[57] ABSTRACT

The powder used in applying a light diffusing coating to the inner wall of an incandescent lamp bulb is deposited substantially free of clumps by, amongst other things, maintaining the powder in suspension in a closed container prior to deposition. The powder in said container is also maintained at a constant level. The powder is carried from the container to the lamp bulbs by a stream of air and is passed through a vortex nozzle which breaks up clumps or agglomerates of powder.

7 Claims, 2 Drawing Figures

APPARATUS FOR COATING INCANDESCENT LAMP BULBS

THE INVENTION

Incandescent lamp bulbs are generally coated by blowing a cloud of finely divided powder, such as silica, into a heated bulb. The powder cloud is passed through the corona of a high voltage probe and receives a charge. An electrode of the opposite polarity is in contact with the bulb to be coated. The charged powder particles travel to the wall of the bulb and are deposited as a thin film on the inside wall.

There have been several different methods disclosed of providing means of directing the powder cloud into the bulb. In general such methods included a powder reservoir containing the powder, and a means for metering measured amounts of the powder into an air stream by which it is conducted into the bulb. A major problem with the above method is that the powder has a tendency to form into small clumps. These clumps, if carried through onto the walls of the bulbs, constitute appearance defects. The nature of the powder is such that it is not a free-flowing material and must be agitated in order to be dispensed. Mechanical agitation, used in most disclosed methods, aggravates the formation of the clumps. Prior art methods for the removal of the clumps removed the agitated powder from the hopper with a stream of air and the powder-air mixture was then blown against a target to pulverize any clumps before passing into the bulb.

The problem with this method was that the impact on the plate tended to form clumps as well as breaking up others. The clumps formed by the impact were either carried into the bulb or dropped back into the powder hopper to be recycled.

An additional problem with existing methods is the difficulty of controlling the rate of powder flow to the bulbs. This results in a wide variation of coating thicknesses on the bulbs and hence changes the light output of the finished lamps.

This invention discloses a method to prevent clump formation and also to provide much closer control of the amount of powder fed to the bulbs, thereby better controlling the coating density from bulb to bulb.

In addition, a method is shown for a closed circuit system that collects all the powder that is not deposited on the bulb wall and returns it to the powder hopper for reuse, because up to 50% of the powder introduced into the bulb does not adhere to the bulb wall and passes out in the air stream.

Figure 1:
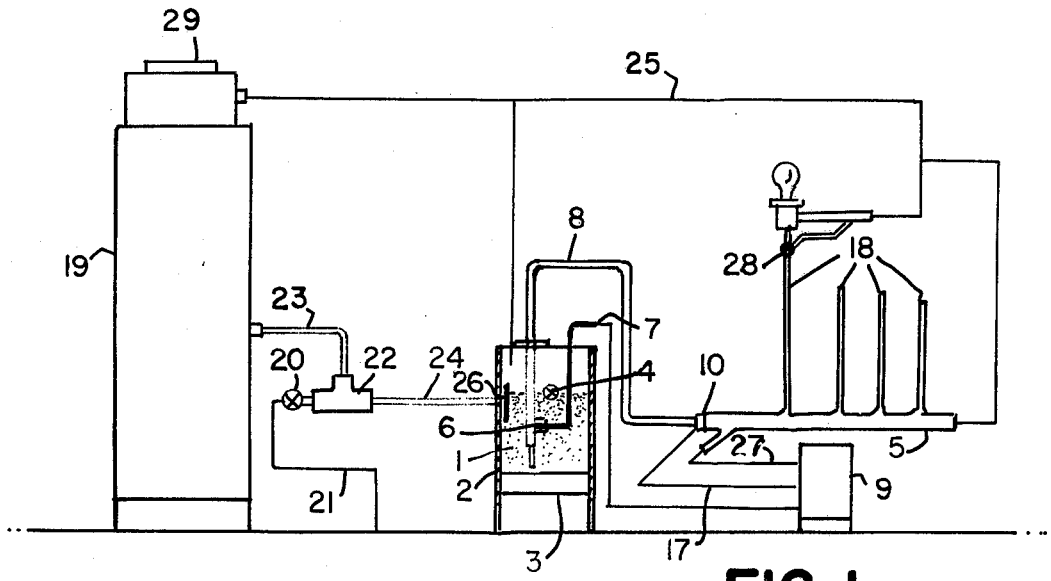
FIG. 1 shows apparatus for coating bulbs in accordance with this invention.

The powder 1 is maintained in suspension in a closed container 2 by means of a fluidizing bed 3. The suspended powder is maintained at a constant level in container 2 by means of a powder level sensor 4. Maintenance of a constant level of powder 1 in container 2 keeps the ratio of powder to air in manifold 5 constant and provides uniform deposition on lamp bulbs.

Powder is introduced into manifold 5 by means of a venturi valve 6 located at the junction of air inlet line 7 and powder outlet line 8. An air supply control panel 9 controls the pressure and cycle time of air supplied to venturi valve 6 through air inlet line 7 which, in turn, controls the density and cycle time of powder introduced into manifold 5 through powder outlet line 8. Located at the inlet end of manifold 5 is a vortex nozzle 10 through which the powder passes from outlet line 8 to manifold 5. The purpose of vortex nozzle 10 is to break up any powder clumps or agglomerates that exist, prior to deposition on the lamp bulbs.

Figure 2:
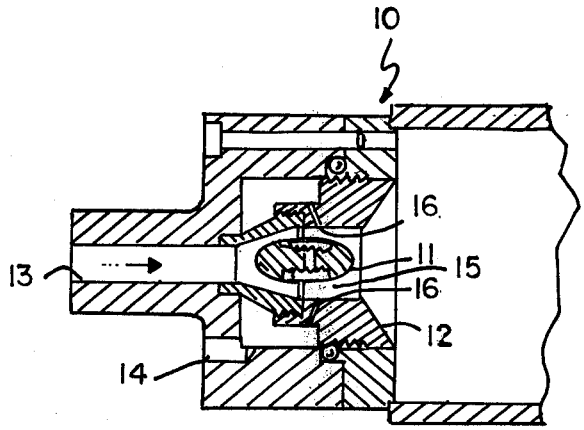
FIG. 2 is an enlarged sectional view of the nozzle used for preventing clump deposition on the bulbs.

Vortex nozzle 10, shown in more detail in FIG. 2, breaks up powder clumps and agglomerates by means of, among other things, a core 11 which is coaxially located within a hub 12. The air-carried powder enters nozzle 10 at inlet 13, is directed past core 11 and passes through a narrow passage 15 between core 11 and hub 12. Each end of core 11 is somewhat bullet-shaped. Also, vortex air is introduced through inlet 14 to six vortex holes 16 which are tangential to the bore thereof and at an angle to its axis so as to impart a forward swirling motion to the powder as it passes through passage 15. The combination of core 11, passage 15 and swirling air from holes 16 break up powder clumps before they can be deposited on the lamp bulbs. The vortex air is controlled by a line 17 connected to control panel 9.

The air-carried powder, after passing through vortex nozzle 10 into manifold 5, is directed into the lamp bulbs through tubes 18 and is electrostatically deposited on the inner bulb walls, as is conventional in the art. However, in accordance with one embodiment of this invention, a single bulb is coated four times, instead of once as is presently conventional. That is to say, a single bulb is indexed through four successive coating stations, at each of which it receives about ¼ of the total powder ultimately deposited thereon. In a typical case of an A19 bulb which contains about 50 mg of deposited powder, about 12½ mg of powder are deposited at each coating station. This improves the uniformity of coating from bulb to bulb.

Since only about 50% of the powder introduced into a bulb is deposited on the bulb wall, a powder return line 25 is used to carry off the undeposited powder. In order to improve material efficiency, line 25 can return the undeposited powder to a storage tank 19 which, in turn, can be the source of supply of powder for container 2.

In operation, sensor 4 is activated when the height of fluidized powder 1 in container 2 falls below a predetermined level. Activation of sensor 4 results in opening of solenoid valve 20 which then permits air from line 21 to pass through venturi powder feed valve 22 and draws powder from storage tank 19 through lines 23 and 24 into container 2. When said predetermined level is reached, sensor 4 closes solenoid valve 20. The powder entering container 2 from line 24 is directed against a baffle 26 which aids in maintaining a uniform powder level in container 2.

In operation, air supply control panel 9 operates in conjunction with the lamp coating machine. When a bulb has been indexed into coating position, a solenoid opens a valve in air inlet line 7 and venturi valve 6 introduces powder from container 2 into powder outlet line 8 where it rapidly flows through manifold 5 and tubes 18 to the bulbs where it is deposited. Air inlet line 7 is open during the time that the coating machine is in a dwell position. At the termination of the dwell cycle, the coating machine indexes to advance the bulbs to their next station. During the index cycle, air inlet line 7 is closed and air line 27 is open in order to permit air to enter manifold 5 in order to purge the powder out of manifold 5 and tubes 18 into line 25. For this purpose a two way valve 28, located near the end of each tube 18, bypasses the coating station and connects tubes 18 with line 25. The purpose of said purging is to provide for a constant density of powder in manifold 5 during the coating cycle in order to maintain uniform deposition from bulb to bulb. Also, purging prevents powder accumulation in manifold 5 and tubes 18, which could result in formation of powder clumps or agglomerates.

Line 17 is also controlled by air supply control panel 9 so that vortexing air is introduced to vortex nozzle 10 only during the dwell cycle of the machine. In one example, where the coating machine indexed once every two seconds, the dwell cycle was one second and the index cycle was also one second.

A cover 29, normally closed, on storage tank 19 permits replenishment of the powder in tank 19. It is also desirable that the powder in tank 19 be maintained in suspension by means of a fluidizing bed. Heavier particles, such as clumps or impurities, remain at the bottom of the bed and are not carried through line 23 into container 2.

Fluidizing air in container 2 is relieved through air relief line 30 to line 25.

We claim:

1. Apparatus for coating incandescent lamp bulbs with powder comprising: a container having means for maintaining the powder in suspension; a constant level sensor means in said container for maintaining the suspended powder at a constant level; a coating manifold; a vortex nozzle; means for drawing suspended powder from said container through said vortex nozzle into said coating manifold; and a tube for carrying powder from said coating manifold to a lamp bulb coating station, wherein said vortex nozzle contains an axial bore connected to said drawing means and a plurality of holes opening inwardly into the bore in a direction toward said manifold and angular with respect to its axis so as to impart a forward swirling motion to powder transported through said nozzle, and means for supplying air to said holes.

2. The apparatus of claim 1 wherein said means for maintaining the powder in suspension comprises a fluidizing bed.

3. The apparatus of claim 1 including, in addition, a two way valve in the tube between said manifold and the coating station and means for regulating said valve so that said tube is connected to said coating station during a predetermined coating and wherein said coating station is bypassed during a predetermined noncoating cycle.

4. The apparatus of claim 3 comprising, in addition, a powder storage tank for supplying powder to said container.

5. The apparatus of claim 4 wherein said constant level sensor operates to draw powder from said storage tank to said container.

6. The apparatus of claim 5 wherein said tube is connected to said storage tank through said two way valve during the predetermined noncoating cycle.

7. The apparatus of claim 1 comprising, in addition, one or more additional tubes for carrying powder from said coating manifold to additional coating stations having means to support said lamp bulbs, one tube per coating station, so that a bulb to be coated receives a fractional amount of the total desired coating at each coating station.

* * * * *